US005595689A

United States Patent [19]

Kulkarni et al.

[11] Patent Number: 5,595,689

[45] **Date of Patent: * Jan. 21, 1997**

[54] HIGHLY CONDUCTIVE POLYMER BLENDS WITH INTRINSICALLY CONDUCTIVE POLYMERS

[75] Inventors: Vaman G. Kulkarni, Charlotte, N.C.; John C. Campbell, Akron, Ohio

[73] Assignee: Americhem, Inc., Cuyahoga Falls, Ohio

[ * ] Notice: The term of this patent shall not extend beyond the expiration date of Pat. No. 5,217,649.

[21] Appl. No.: 278,165

[22] Filed: Jul. 21, 1994

[51] Int. Cl.[6] ..... H01B 1/00; H01B 1/12

[52] U.S. Cl. ..... 252/500; 524/104; 524/109; 528/427

[58] Field of Search ..... 252/500; 528/422, 528/423, 424; 524/104, 107

[56] References Cited

U.S. PATENT DOCUMENTS

| | | | |
|---|---|---|---|
| H944 | 8/1991 | Wade, Jr. et al. | 252/500 |
| 4,052,493 | 10/1977 | Etchells | 264/49 |
| 4,061,827 | 12/1977 | Gould | 428/368 |
| 4,129,677 | 12/1978 | Boe | 428/372 |
| 4,526,706 | 7/1985 | Upson et al. | 252/500 |
| 4,604,427 | 8/1986 | Roberts et al. | 525/185 |
| 4,617,228 | 10/1986 | Newman et al. | 428/265 |
| 4,665,129 | 5/1987 | Naarmann et al. | 525/186 |
| 4,711,742 | 12/1987 | Jen et al. | 252/500 |
| 4,772,421 | 9/1988 | Ikenaga et al. | 252/500 |
| 4,828,756 | 5/1989 | Benton et al. | 252/518 |

(List continued on next page.)

FOREIGN PATENT DOCUMENTS

| | | | |
|---|---|---|---|
| 0421814A2 | 10/1990 | European Pat. Off. | H01B 1/12 |
| 61-127737 | of 1984 | Japan | C08J 3/20 |
| 2214511 | 1/1989 | United Kingdom | C08K 3/00 |
| WO89/01694 | 7/1988 | WIPO | H01B 1/12 |
| WO89/02155 | 9/1988 | WIPO | H01B 1/12 |
| WO90/10297 | 9/1990 | WIPO | H01B 1/12 |

OTHER PUBLICATIONS

Translation of Japanese Patent No. 61-127737 entitled "Formulation Method of Electrically Conducting Polymer Composites" prepared by Myong Ok Song (May 29, 1987).

(List continued on next page.)

*Primary Examiner*—Paul Lieberman
*Assistant Examiner*—M. Kopec
*Attorney, Agent, or Firm*—Renner, Kenner, Greive, Bobak, Taylor & Weber

[57] ABSTRACT

A polymer blend according to the invention of the type including an intrinsically conductive polymer disbursed in a matrix selected from thermoplastic polymers, monomers, polymerizable precursors and combinations thereof is improved by an amount of a non-polymeric polar additive having a boiling point greater than about 100° C. at 760 mm pressure and greater than the processing temperature of the matrix polymer incorporated in the polymer blend, in an amount sufficient to impart an electrical conductivity to the blend which is greater than that of the blend without the non-polymeric polar additive. A blend according to the invention includes a matrix material selected from thermoplastic polymers, monomers and polymer precursors and combinations thereof, and an intrinsically conductive polymer and a non-polymeric highly polar additive, disbursed into a polymer blend and having a conductivity of greater than about 2.5 S/cm. A composition according to the invention includes a precursor selected from polymers and polymerizable monomers, an intrinsically conductive polymer with a conductivity of about 1 to 5 S/cm and a non-polymeric polar additive having a conductivity of greater than that of the blend resulting in a blend having a conductivity greater than about 2 to 5 s/cm. A blend having thermo and conductive stability includes an intrinsically conductive polymer, an insulating thermoplastic polymer, an insulating thermoplastic polymer and an ester-free plasticizer which is thermally stable to at least about 240° C., the blend having a conductivity of greater than $10^{-2}$S/cm. A method for preparing such compositions and blends is also provided.

11 Claims, 1 Drawing Sheet

U.S. PATENT DOCUMENTS

| | | | |
|---|---|---|---|
| 4,855,361 | 8/1989 | Yaniger et al. | 525/436 |
| 4,929,388 | 5/1990 | Wessling | 252/500 |
| 4,935,164 | 6/1990 | Wessling et al. | 252/500 |
| 4,983,322 | 1/1991 | Elsenbaumer | 250/500 |
| 4,983,690 | 1/1991 | Cameron et al. | 525/436 |
| 5,006,278 | 4/1991 | Elsenbaumer | 427/385.5 |
| 5,021,193 | 6/1991 | Armes et al. | 252/500 |
| 5,034,463 | 7/1991 | Brokken-Zijp et al. | 525/185 |
| 5,079,096 | 1/1992 | Miyake et al. | 428/500 |
| 5,130,054 | 7/1992 | Jasne | 252/500 |
| 5,143,650 | 9/1992 | Gerace et al. | 252/511 |
| 5,217,649 | 6/1993 | Kulkarni et al. | 252/500 |
| 5,232,631 | 8/1993 | Cao et al. | 252/500 |
| 5,340,499 | 8/1994 | Karna et al. | 252/518 |

OTHER PUBLICATIONS

"An Electrically Conductive Plastic Composite Derived from Polypyrrole and Poly(vinyl Chloride)" by De Paoli et al., *Journal of Polymer Science* vol. 23 (1985) No Month Available.

"Conducting polymer fibre prepared by melt–spinning method from fusible polythiophene derivative" by Yoshino et al., *Polymer Communications* vol. 28, (Nov. 1987).

"Electrically–Conductive Fibers of Polyaniline Spun From Solutions In Concentrated Sulfuric Acid" by Andreatta et al., *Synthetic Metals*, 26, pp. 383–389 (1988) No Month Available.

"Spectroscopic Studies of Polyaniline In Solution and In Spin–Case Films" by Cao et al., *Synthetic Metals*, 32, pp. 263–281 (1989) No Month Available.

HIGHLY CONDUCTIVE POLYMER BLENDS WITH INTRINSICALLY CONDUCTIVE POLYMERS

TECHNICAL FIELD

This invention relates to intrinsically conductive polymers. Specifically the invention relates to polymer blends between intrinsically conductive polymers and conventional insulating polymers. More specifically, the present invention relates to significantly improved formulations of blends with intrinsically conductive polymers such as polyaniline which result in enhanced conductivity of said blends.

BACKGROUND OF THE INVENTION

Blends with intrinsically conductive polymers, especially with dispersible intrinsically conductive polymers in powder form that are significant for technical applications, are described in U.S. Pat. No. 5,217,649 and PCT/EP88/00798. The definitions and concepts described therein are also applicable to the present application and are, therefore, incorporated by reference herein.

Such blends show conductivities in the range of $10^{-9}$ up to about 2.5 S/cm. The upper limit being the conductivity of the virgin conductive polymer in a dispersible form, which iS typically in the range of 1–10 S/cm. We define herein a dispersible intrinsically conductive polymer (ICP) as capable of being dispersed by conventional means in a liquid matrix or a polymer matrix such that at least 50 percent of the ICP by weight is present at a particle size of less than 500 mm.

For several applications such as electromagnetic interference (EMI) shielding and the like, the conductivity of known intrinsically conductive polymers falls short of commercial interest. For example, it has been shown by Shacklette et al., Journal of Vinyl Technology 14(2), 118, 1992, that in order to achieve 40 dB shielding, which represents a minimum requirement for many commercial applications, a minimum thickness of 3 mm with such conductivities is required. There are also requirements on the mechanical properties of such blends which would prevent the use of more than about 25 percent by volume of a conductive polymer in such a blend. The upper conductivity limit of 1–5 S/cm for blends with acceptable mechanical properties, which has hitherto been impossible to exceed, limits technical applications for such blends.

There is, therefore, a need—not only for applications in the field of EMI shielding—to increase the conductivity of polymer blends with intrinsically conductive polymers. In particular, there is a need to increase the conductivity of blends with polyaniline (in thermoplastic or non-thermoplastic polymers or in paints or other applications).

The term "intrinsically conductive polymer" (ICP) refers to organic polymers containing polyconjugated bond systems such as double and triple bonds and aromatic rings which have been doped with electron donor or electron acceptor dopants to form a charge transfer complex having an electrical conductivity of at least about $10^{-6}$ S/cm by the four-in-line probe method. Examples of such polymers are polyaniline, polypyrrole, polyacetylene, polythiophene, polyphenylene and the like.

There recently has been increased interest in processing of intrinsically conductive polymers into useful conductive materials. Polyaniline in particular has received considerable attention due to its ease of manufacture, environmental stability and moderate conductivity. In its doped form it has a conductivity in the 1–5 S/cm range. See for example, U.S. Pat. No. 5,160,457; 4,069,820; 4,915,164; 4,929,388; 4,983,322; PCT applications WO 89/02155, 90/10297 and Synthetic Metals, volumes 1–57.

In recent years scientists have made considerable efforts to achieve higher conductivities. The following processes have so far been used on a laboratory scale with pure ICP's:

1. Polymerization of polyacetylene in viscous non-polar media, followed by stretching and subsequent doping with iodine (Naarmann and Theophilo, Synthetic Metals 22 1 (1987)). Conductivities of several times $10^4$ S/cm have been achieved. The process has the disadvantage that it is difficult to perform, difficult to reproduce and results in a conductive polymer that is not air and oxidation resistant and not processable. Owing to these problems, polyacetylene has remained a laboratory curiosity.
2. Polyprrole can be polymerized under specific electrochemical conditions to films that have a conductivity of several times $10^2$ S/cm. This process has the disadvantage that only self-supporting films can be produced which are not processable or dispersible, and are also not sufficiently stable at medium high temperatures.
3. Recently, fairly high conductivities have been reported in polyaniline, see for example Y. Cao et al. (Synth. Met. 48, 91 (1992), Appl. Phys. Lett. 60, 2711 (1992), Y. Cao et al., Synth. Met. 55–57 (1993) 3514–3519. This process involves synthesizing polyaniline protonated ("doped") with hydrochloric acid, neutralizing it to obtain emeraldine and then protonating it again with another acid, in this case preferably camphor sulfonic acid in the presence of m-cresol. The resulting nondispersible self-supporting films possessed a conductivity of about $1.5\times10^2$ S/cm. In addition to their non-dispersibility and the highly complex process by which they are made, a further disadvantage must be seen in the fact that some of the m-cresol remains in the conductive film and potential toxicological problems arise both during the process and during later use. The process is believed to enhance the conductivity via increased crystallinity and solubility, camphor sulfuric acid/m-cresol induced solubility.
4. A. Monkman et al. Solid State Commun. 78, 29 (1991) reported a conductivity of 60 to 70 S/cm for films cast from N-methylpyrrolidone (NMP), which were doped with HCl, and 200 to 350 S/cm when neutral polyaniline films (films of emeraldine base) were stretched and subsequently doped. These films cannot be subsequently processed into any other useful forms and are not dispersible under the definition given herein.
5. Recently, B. Wessling et al. (DE Pat. Application P 43 17 010 2) have shown that a significant increase in conductivity in intrinsically conductive polymers, preferably polyaniline, in raw powder form can be achieved by an additional dispersion process in the pure state, leading to enhanced conductivity values of greater than about $2.5\times10^1$ S/cm.
5. Alternatively, chain alignment of polyaniline has been achieved via solution spinning from concentrated sulfuric acid to produce fibers of polyaniline with enhanced crystallinity and high conductivity in a range from 20 to 60 S/cm (A. Andreatta, Synth. Met. 26, 383 (1988)).
7. It is also known that the conductivity of polyaniline is enhanced through hydration by water. Such a hydrated polyaniline is difficult to process by conventional thermoplastic means since the water has detrimental effect on the thermoplastic polymer as well as the conductivity of the blend or it causes the polyaniline to become insoluble or undispersible in conventional organic solvents. Since the water would be the last from the polyaniline during exposure to elevated temperature (greater than about 30° C.) or during exposure to less humidity conditions (less than 50 percent RH), the conductivity will have less thermal stability and less humidity independence than would a polyaniline complexed with the less volatile polar materials of the present invention.

In summary, the prior art discloses conductivity enhancing processes that are complicated multistage processes and/or those requiring subsequent doping. Furthermore, other fundamental disadvantages still exist in that the resulting products are not further processable or dispersible. For instance, oriented fibers or polyaniline or other conductive polymers must be subsequently used in fiber form to preserve their enhanced conductivity which is produced by chain alignment.

Therefore, there remains a need to create intrinsically conductive polymer blends, with conventional insulating polymer which are processable by conventional techniques such as injection molding, extrusion, calendaring, or the like, and which possess a conductivity of greater than 2.5 preferably greater than 25 and most preferably from 100 to $2.5\times10^5$ S/cm, without complicated multi-step processes or predispersion steps.

DISCLOSURE OF THE INVENTION

It is therefore, an object of the present invention to provide a formulation and a method for preparation of intrinsically conductive polymer blends with a conductivity of at least about 2.5 S/cm in a form which can be reprocessed via conventional thermoplastic or solution techniques to again yield a conductivity greater than about 2.5 S/cm.

It is another object of the present invention to provide a formulation and method of preparing blends with doped polyaniline, doped with conventional dopants such as hydrochloric and organic sulfonic acids with conductivity greater than about 2.5 S/cm.

It is still another object of the present invention to prepare coatings that are highly conductive, that is preferably greater than about 2.5 , more preferably greater than about 25 and more preferred still, from about 2.5 to $100\times10^5$ S/cm, without complicated multi-step processes or predispersion steps.

The invention relates to the formulation and preparation of intrinsically conductive polymer blends containing a non-polymeric polar substance with a conductivity of greater than about 2.5 S/cm. The intrinsically conductive polymer is dispersed in the presence of a non-polymeric, non-conductive polar material (number-average molecular weight less than about 5000) and a conventional polymer and processed at elevated temperature.

Preferred classes of non-polymeric, polar materials include, for example, carbonates, esters, phosphate esters, lactones (R—O—C(O)R), ethers (R—O—R'), pyrrolidones, amides, ureas, nitriles, sulfonamides (R—SONH—), and sulfones. R and R' are the same or different and can be hydrogen; aliphatic radicals having from 1 to about 10 carbon atoms, such as $—CH_3$, $—C_2H_5$, and the like; or, aromatic radicals such as $—C_6H_5$, including benzene, naphthalene and the like.

Examples of such materials include butyrolactone, N-butyl benzene sulfonamide, dimethyl formamide (DMF), dioxane, N-methylpyrrolidone (NMP), glymes, hydroxynaphthalene, propylene carbonate, glycols, ethylene carbonate, dimethyl sulfoxide, sulfolane, and the like. This list is provided for the purpose of example and is by no means exhaustive.

Another characteristic of the preferred polar materials is that they have low volatility and high boiling point. This property allows them to survive processing at elevated temperature and to be retained within the blend after processing. Preferred polar materials have a boiling point greater than about 100° C. at 760 mm of mercury of pressure and preferably greater than about 150° C., and more preferred still, greater than about 200°C. The polar additive preferably has a boiling point higher than the processing temperature of the matrix polymer into which it is incorporated.

The polarity of the polar material is also critical to its function and preferred materials have a surface tension greater than about 30 dynes/cm and a relative dielectric constant greater than about 5, more preferably greater than about 10, and more preferred still, greater than about 15. An alternative measure of polarity is obtainable from the electric intrinsic dipole moment. Dipole moments are preferably greater than about 1.5 decibles, more preferably greater than about 2.0, more preferred still, greater than about 2.5.

The polar nonconductive substance, which is relatively chemically inert in relation to the intrinsically conductive polymer, is added in an amount that yields a ratio of conductive polymer powder to polar substance of between 20:1 and 1:10 by weight, more preferably from 5:1 to 1:5.

Preferably the polymer blend contains from 1 to 40 parts of polyaniline and 1 to 40 parts of the non-polymeric polar material and 98 to 20 parts of matrix polymer, which can be thermoplastic, thermoset or a polymerizable polymer precursor or monomer. Examples of useful thermoplastic polymers include polyethylene, polypropylene, acrylics, polyesters, nylons, polycarbonates, acrylonitrile/butadiene/styrene, blends thereof and the like. Thermosetting polymers include any polymers which will cross-link with the application of heat, including for example acrylics, polyesters, epoxies, urethanes, silicones, mixtures thereof and the like. Exemplary polymer precursors include acrylics, urethanes, polyesters, epoxies, silicones, mixtures thereof and the like. Useful polymerizable monomers include those listed hereinabove, mixtures thereof and the like. It will be appreciated that an amount of the polar material is added sufficient to impart an electrical conductivity to the blend which is greater than that of the blend without the additive.

The dispersion may also contain other additives such as processing aids, dispersants and plasticizers. When the dispersion contains such additives, the amount of thermoplastic is reduced by the amount corresponding to the amount of additive.

The preparation of the polymer blend is carried out under high shear, such as at least about 300 rotations/second, in Banbury mixers, extruders, high speed blenders, two- or three-roll mills and the like. Here, the conductive polymer is dispersed in a polymer matrix comprising one or more thermoplastic polymers, or thermoset polymers or blends thereof or monomers/polymer precursors that are capable of being polymerized later. The processing is typically carried out below the flash point of the polar material.

The advantages provided by the addition of a polar material to the blend are multifold. While we do not wish to be bound by any theory, it is our belief that the polar material solvates the intrinsically conductive polymer and thereby produces a better delocalization of charge along the polymer chain, a process which directly results in higher conductivity. The polar material may, via a plasticization effect, also result in the re-ordering of neighboring chains of the conductive polymer to achieve better chain alignment on a molecular level. This improved chain alignment will result in improved mobility of charge between chains, thereby promoting enhanced three-dimensional conductivity. Further, the polar material improves the dispersibility of the conductive polymer and/or aids in the formulation of percolated two or three-dimensional networks within the blend.

The polymer blends according to the present invention will display a more constant resistance as a function of humidity than that displayed by the blend without the non-polymeric polar additive. Further, the blends will display a thermostability of conductivity which is greater than that of the blend without the non-polymeric polar additive. The compositions according to the present invention may be cast or otherwise formed as a thin film upon a substrate such as those selected from plastic, glass, paper and metal. Also, when a plasticizer is used it is preferred that it be ester free and further preferred that it be a sulfonamide as is exemplified hereinbelow.

At least one or more of the foregoing objects, together with the advantages thereof over the known art relating to electrically conductive polymeric compositions which shall become apparent from the specification which follows, are accompanied by the invention hereafter described and claimed.

PREFERRED EMBODIMENT FOR CARRYING OUT THE INVENTION

Figure 1:
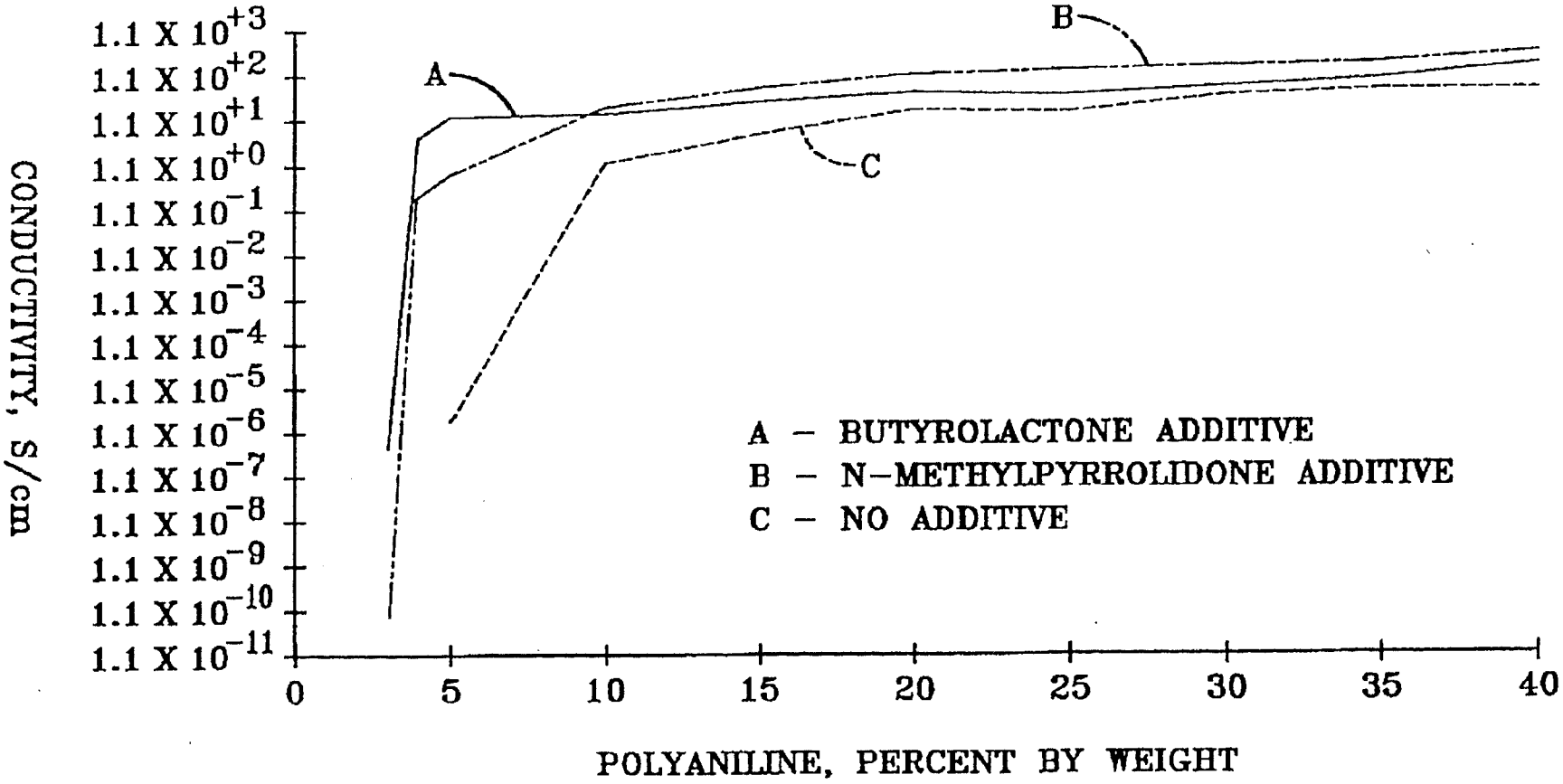
FIG. 1 is a percolation curve for polyanile in polymethylmethacrylate with various additives as indicated.

According to the present invention, a novel method of enhancing the conductivity of intrinsically conductive polymers, blends, coatings and other articles derived from intrinsically conductive polymers, preferably polyaniline, is provided. The high conductivity in blends is brought about by treating doped intrinsically conductive polymers with highly polar organic materials.

The above compositions after incorporation of the organic polar substance are surprisingly higher in conductivity than the raw intrinsically conductive polymer powder, despite the fact that they contain a lower amount of intrinsically conductive polymer.

While the technique is applicable to any doped intrinsically conductive polymer, preferred intrinsically conductive polymers are those selected from the class of doped polyanilines, preferred doped polyanilines are the ones that are doped with sulfonic, phosphonic, sulfonic, or phosphinic acids. It is preferred that the polyaniline be in a dispersible powdered form so that the maximum surface area of the conductive polymer is exposed for treatment.

EXPERIMENTAL

EXAMPLE 1

A composition containing 40 grams of VERSICON® (doped polyaniline made by Allied Signal, Buffalo, N.Y.), 35 grams of polymethyl methacrylate, 15 grams of gamma butyrolactone, 5 grams each of sulfonamide plasticizer and organic phosphate ester was processed on a two-roll mill. The resulting compound was pressed into a flat sheet using a platen press. The sample showed an electrical conductivity of $2.7\times10^{1}$ S/cm.

EXAMPLE 2

A comparative sample of Example 1 without the butyrolactone had a conductivity of 2 S/cm.

EXAMPLE 3

60 grams of VERSICON® and 30 grams of butyrolactone were preblended with 10 grams of polymethyl methacrylate in a high speed mixer and processed on a two-roll mill. The resulting formulation had a conductivity of $8\times10^{1}$ S/cm.

EXAMPLE 4

A composition containing 40 grams of VERSICON® (doped polyaniline, Allied Signal), 25 grams of polymethyl methacrylate, 15 grams of gamma butyrolactone, 15 grams of sulfonamide plasticizer and 5 grams of an organic phosphate ester was processed on a two-roll mill. The resulting compound was pressed into a flat sheet using a platen press. The sample showed an electrical conductivity of $3.5\times10^{1}$ S/cm.

EXAMPLE 5

A composition containing 40 grams of VERSICON®, 35 grams of nylon copolymer, 5 grams each of a sulfonamide plasticizer, organic phosphate ester and 15 grams of gamma butyrolactone was processed on a two-roll mill. The resulting compound had an electrical conductivity of about $2.5\times10^{1}$ S/cm.

EXAMPLE 6

In order to demonstrate the changes in conductivity as a function of polyaniline concentration, percolation curves for polyamine in polymethyl methacrylate with formulations containing butyrolactone and N-methyl pyrrolidone based on Example 1, compared with a formulation without these additives are shown in FIG. 1.

The results show improved conductivity and percolation thresholds for both polar additives over those observed for the blend without a polar additive.

EXAMPLE 7

Six different compounds, containing 48 parts by weight of chlorinated polyethylene, 2 parts by weight of a stabilizer (Barium/Cadmium, zinc soap, organo tin mercaptide or other useful stabilizer) 15 parts by weight of n-butyl benzene sulfonamide (NBBSA) or a sulfonamide plasticizer with stability in excess of 240° C. (such as Plasticizer-J from Hardwicke Chemical Company), 5 parts by weight of an organic phosphate ester type surfactant, 20 parts of doped polyaniline, and 10 parts of carbon black were prepared using a Brabender. Sixty-eight grams of the samples were charged to a Brabender mixer set at 185° C. and 55 RPM and allowed to run for 30 minutes. The conductivity of the samples as prepared, and after mixing in the Brabender for 30 minutes were measured using 4-probe technique. Results are shown in Table I.

TABLE I

EFFECT OF HEAT ON VARIOUS CONDUCTIVE COMPOSITIONS

| | PLASTICIZER | | | |
|---|---|---|---|---|
| | NBBSA | | PLASTICIZER-J | |
| STABILIZER | As Is | 185° C./30 min. | As Is | 185° C./30 min |
| Ba/Cd soap | 1.50 | $1.5 \times 10^{-4}$ | 5.0 | 0.20 |
| Organo Tin Mercaptide | 1.20 | $4.0 \times 10^{-7}$ | 1.9 | $1.8 \times 10^{-4}$ |
| Zinc soap | 1.40 | $1.3 \times 10^{-8}$ | 4.2 | $4.5 \times 10^{-5}$ |

Compounds containing N-butyl benzene sulfonamide (NBBSA) gave off significant fumes during processing, while the compounds containing Plasticizer-J processed with no fumes. Further compounds containing N-butyl benzene sulfonamide had partly degraded appearance.

The results clearly demonstrate that plasticizer with high thermal stability acts as thermal and conductivity stabilizers for conductive polymer compositions tested.

EXAMPLE 8

Table 2 shows the thermal stability data for N-butyl benzene sulfonamide (NBBSA) and Plasticizer-J. The data were obtained from a thermogravimetric curve obtained using a Mettler TGA 50 at a heating rate of 20° C./min.

TABLE II

THERMAL STABILITY OF N-BUTYL BENZENE SULFONAMIDE AND PLASTICIZER-J

| | NBBSA | PLASTICIZER-J |
|---|---|---|
| 5% loss | 205° C. | 340° C. |
| 10% loss | 225° C. | 355° C. |
| 25% loss | 260° C. | 378° C. |
| 50% loss | 280° C. | 396° C. |
| 80% loss | 296° C. | 430° C. |

NBBSA is nearly completely decomposed at 300° C., while Plasticizer-J has lost only a small fraction. The results clearly demonstrate the high thermal stability of Plasticizer-J.

Based upon the foregoing exemplification, it can be seen that the present invention provides highly electrically conductive polymer blends with intrinsically conductive polymers. It is to be understood that the examples reported herein have been provided to present results obtainable by practice of the disclosed invention. Inasmuch as a wide variety of polymers, intrinsically conductive polymers, non-polymeric polar additives, plasticizers, and other components of the present invention have been disclosed for use in conjunction with the invention, this invention is not limited to the specific examples provided herein. Furthermore, the process for preparing these conductive blends is believed to be operable with components, concentrations and conditions other than those which have been exemplified herein. Thus, it should be evident that the determination of particular components, concentrations and other conditions, can be made without departure from the spirit of the invention herein disclosed and described. The scope of the invention shall include all modifications and variations that fall within the scope of the attached claims.

What is claimed is:

1. In a polymer blend of the type comprising an intrinsically electrically conductive polymer dispersed in a matrix selected from the group consisting of thermoplastic polymers, the improvement comprising;

an amount of a non-polymeric polar additive having a boiling point greater than about 100° C. at 760 mm and selected from the group consisting of pyrrolidones and lactones, having the formula R—O—C (O)R, where R is selected from the group consisting of hydrogen, aliphatic radicals having from 1 to about 10 carbon atoms and aromatic radicals, and mixtures thereof incorporated in said polymer blend in an amount sufficient to impart an electrical conductivity to the blend which is greater than that of the blend without the non-polymeric polar additive;

wherein the electrical conductivity of the blend is greater than about 10 S/cm.

2. A polymer blend comprising:

a matrix material selected from the group consisting of thermoplastic polymers, thermosetting polymers, and combinations thereof; and an intrinsically conductive polymer and a non-polymeric highly polar additive, selected from the group consisting of pyrrolidones and lactones, having the formula R—O—C (O)R, where R is selected from the group consisting of hydrogen, aliphatic radical having from 1 to about 10 carbon atoms and aromatic radicals, and mixtures thereof dispersed into a polymer blend and having a conductivity of greater than about 10 S/cm.

3. The polymer blend of claim 2, which further displays a more constant resistance as a function of humidity than that displayed by the blend without the non-polymeric polar additive.

4. The polymer blend of claim 2, which further displays a thermal stability of conductivity which is greater than that of the blend without the non-polymeric polar additive.

5. The polymer blend of claim 2, wherein said intrinsically conductive polymer is polyaniline.

6. The polymer blend of claim 4, wherein said non-polymeric polar additive has a surface tension greater than about 30 dyne S/cm.

7. The polymer blend of claim 2, wherein said intrinsically conductive polymer and said additive are present in a ratio of between about 20:1 to about 1:10 by weight.

8. A conductive polymer blend having thermal and conductive stability comprising:

an intrinsically conductive polymer;

an insulating thermoplastic polymer;

an ester-free plasticizer which is thermally stable to at least about 240° C.; and a non-polymeric polar additive having a boiling point greater than about 100° C. at 760 mm selected from the group consisting of pyrrolidones and lactones, having the formula R—O—C(O)R, where R is selected from the group consisting of hydrogen, aliphatic radicals having from 1 to about 10 carbon atoms and aromatic radicals, and mixtures thereof, the blend having a conductivity of greater than about $10^{-2}$ S/cm.

9. A conductive polymer blend as in claim 8, wherein the ester-free plasticizer is a sulfonamide.

10. The polymer blend of claim 4, wherein said non-polymeric polar additive has an electric dipole greater than about 1.5 decibles and a relative dielectric constant greater than about 5.

11. A polymer blend comprising:

a matrix material selected from the group consisting of thermoplastic polymers, thermosetting polymers, and combinations thereof; and conductive polyaniline and a non-polymeric highly polar additive, selected from the group consisting of pyrrolidones and lactones, having the formula R—O—C(O)R, where R is selected from the group consisting of hydrogen, aliphatic radicals having from 1 to about 10 carbon atoms and aromatic radicals, and mixtures thereof dispersed into a polymer blend and having a conductivity of greater than about 10 S/cm.

* * * * *

UNITED STATES PATENT AND TRADEMARK OFFICE

CERTIFICATE OF CORRECTION

PATENT NO. : 5,595,689

DATED : January 21, 1997

INVENTOR(S) : Vaman G. Kulkarni and John C. Campbell

It is certified that error appears in the above–identified patent and that said Letters Patent are hereby corrected as shown below:

In column 8, line 27, the word radical should appear in plural form, i.e. radicals.

Signed and Sealed this

Twenty-first Day of October 1997

Bruce Lehman

*Attest:*

BRUCE LEHMAN

*Attesting Officer*

*Commissioner of Patents and Trademarks*